United States Patent [19]

Kischio

[11] 4,032,808

[45] June 28, 1977

[54] ELECTRIC INCANDESCENT LAMP

[75] Inventor: Werner Kischio, Aachen-Orsbach, Germany

[73] Assignee: U.S. Philips Corporation, New York, N.Y.

[22] Filed: Apr. 2, 1976

[21] Appl. No.: 673,271

[30] Foreign Application Priority Data

Apr. 12, 1975 Germany ..... 2516102

[52] U.S. Cl. ..... 313/178; 313/174; 252/181.1

[51] Int. Cl.[2] ..... H01J 61/24

[58] Field of Search ..... 313/222, 174, 176, 178, 313/179; 252/181.1, 181.2

[56] References Cited

UNITED STATES PATENTS 3,898,500 8/1975 Johnson et al. ..... 313/174

*Primary Examiner*—Rudolph V. Rolinec
*Assistant Examiner*—Darwin R. Hostetter
*Attorney, Agent, or Firm*—Frank R. Trifari; Robert S. Smith

[57] ABSTRACT

The use of phosphorthionitride as a getter in electric incandescent lamps having an envelope, current carrying members, and a filament.

1 Claim, 1 Drawing Figure

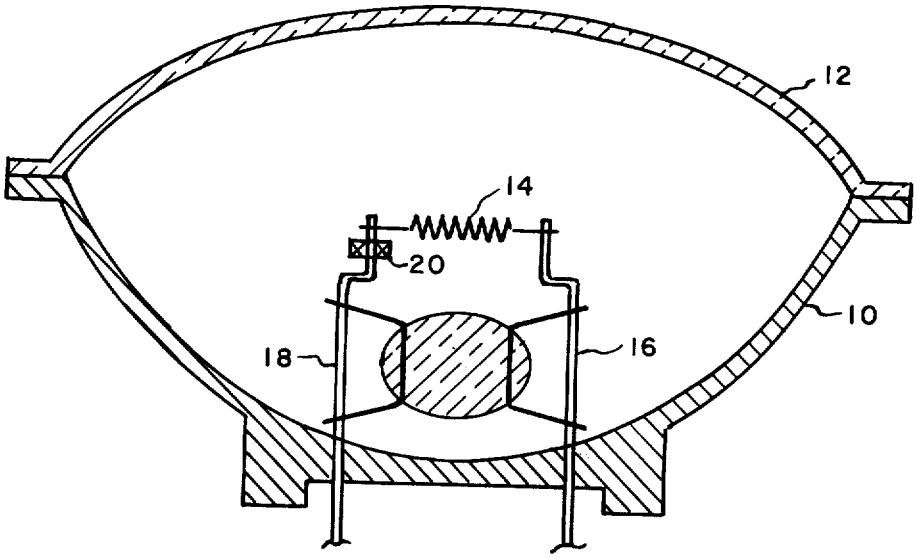
12
14
20
10
18
16

ELECTRIC INCANDESCENT LAMP

The invention relates to an electric incandescent lamp whose lamp envelope comprises an oxygen getter.

In the manufacture of incandescent lamps it is usual to provide a getter which is volatilized or decomposed during operation of the lamp and, with the residues of oxygen and water still present in the lamp envelope, forms compounds and thus binds said substances.

It is known (German Patent Specification No. 1,764,332) to use $P_3N_5$ as a getter which is decomposed only at temperatures above approximately 750° C in phosphorus and nitrogen. However, excessive phosphorus deposits as a brown coating on the lamp envelope and thus reduces the luminous efficiency.

It is furthermore known from German Offenlegungsschrift No. 2,217,531 to use phosphor oxynitride (PON) as a getter in incandescent lamps. At the temperature of the filament, PON is decomposed while forming phosphorus, phosphorpentoxide ($P_2O_5$) and nitrogen. In forming $P_2O_5$ the water vapour residues in the lamp are gettered, while the phosphorus released during the decomposition serves to bind oxygen residues in the lamp. In this case also, the releasing phosphorus may deposit on the lamp envelope as a disturbing coating.

It is an object of the invention to find a gettering material for incandescent lamps which shows a good gettering activity for oxygen but which does not produce disturbing deposits on the lamp envelope.

In incandescent lamps of the kind mentioned in the preamble this is achieved according to the invention in that phosphorthionitride (PNS) is used as a gettering material.

PNS is decomposed at the filament temperature, $P_2O_5$ being formed before $SO_2$ as an oxidation product, since $P_2O_5$ has a much more negative formation enthalpy than $SO_2$. Excessive phosphorus, however, does not deposit as a brown coating on the lamp envelope but is bound by the sulphur as a substantially colourless phosphor sulphide. This material is capable of operating as a getter, and that both with respect to oxygen and with respect to water vapour.

PNS may be used as a getter both in vacuum incandescent lamps and in gas-filled incandescent lamps. The latter comprise fillings of nitrogen and/or rare gas. In incandescent lamps having a halogen-containing filling for producing a tungsten-halogen cycle, PNS may also be used as a getter.

The getter is preferably provided on or in the proximity of the filament. This may be done, for example, by providing on the stem or on the filament a suspension of finely ground PNS in a volatile organic solvent, after which the solvent is evaporated. As a solvent may be used, for example, hydrocarbons.

The apparatus in accordance with the invention in one form includes an envelope, (which comprises elements 10, 12); current carrying supports 16, 18; a filament 14, and the getter 20.

In a particular embodiment, 20 g of PNS were ground in a ballmill with 0.7 liter of toluene for 24 hours. A filament was dipped in the resulting suspension, the solvent was evaporated, after which the filament was assembled in a lamp envelope. The envelope was evacuated, filled with an inert gas and sealed.

What is claimed is:

1. An electric incandescent lamp which comprises: a closed envelope; two conductive members extending through said envelope; a filament connected between said members and disposed within said envelope; and an oxygen getter, said oxygen getter being phosphorthionitride (PHNS).

* * * * *